US012264891B2

(12) United States Patent
Stolz et al.

(10) Patent No.: US 12,264,891 B2
(45) Date of Patent: Apr. 1, 2025

(54) FEEDING DEVICE FOR LOADING AND UNLOADING A RADIALLY OPENING AMMUNITION CUP FOR AN AUTOMATIC GUN LOADING SYSTEM

(71) Applicant: RHEINMETALL AIR DEFENCE AG, Zurich (CH)

(72) Inventors: Gerhard Stolz, Zurich (CH); Thomas Strebel Marzano, Birmenstorf (CH)

(73) Assignee: RHEINMETALL AIR DEFENCE AG (CH)

( * ) Notice: Subject to any disclaimer, the term of this patent is extended or adjusted under 35 U.S.C. 154(b) by 0 days.

(21) Appl. No.: 17/907,233

(22) PCT Filed: Jul. 5, 2022

(86) PCT No.: PCT/EP2022/068604
§ 371 (c)(1),
(2) Date: Sep. 23, 2022

(87) PCT Pub. No.: WO2023/285209
PCT Pub. Date: Jan. 19, 2023

(65) Prior Publication Data

US 2024/0219137 A1 Jul. 4, 2024

(30) Foreign Application Priority Data

Jul. 12, 2021 (DE) ..... 102021117951.3

(51) Int. Cl.
*F41A 9/76* (2006.01)
*F41A 9/16* (2006.01)
(Continued)

(52) U.S. Cl.
CPC ..... *F41A 9/76* (2013.01); *F41A 9/16* (2013.01); *F41A 9/22* (2013.01); *F41A 9/83* (2013.01)

(58) Field of Classification Search
CPC ..... F41A 9/09; F41A 9/16; F41A 9/20; F41A 9/22; F41A 9/76; F41A 9/83
(Continued)

(56) References Cited

U.S. PATENT DOCUMENTS 1,310,890 A * 7/1919 Schneider ..... F41A 9/16 89/47
3,044,362 A * 7/1962 Carlberg ..... F41A 23/20 89/1.7
6,591,733 B1 * 7/2003 Engstrom ..... F41A 9/16 89/46

FOREIGN PATENT DOCUMENTS

DE 4324572 A1 * 1/1995 ..... F41A 9/20
EP 1384969 A2 * 1/2004 ..... F41A 9/20
(Continued)

*Primary Examiner* — Joshua E Freeman
*Assistant Examiner* — Benjamin S Gomberg
(74) *Attorney, Agent, or Firm* — NGUYEN TARBET IP LAW

(57) ABSTRACT

A feeding device for loading and unloading a radially opening ammunition cup for an automatic loading system of a gun, including: a housing, a loading opening and a radially opening ammunition cup. An ammunition can be inserted into the ammunition cup in the radial direction through the cup opening The feeding device includes a carriage and a holding device. The holding device is designed to move in a first position to be loaded and unloaded with the ammunition and is adapted to transfer the ammunition arranged in the holding device to the ammunition cup in a second position to take the ammunition arranged in the ammunition cup out of the ammunition cup, wherein the carriage can be guided through the loading opening during the movement from the first position into the second position or vice versa.

19 Claims, 10 Drawing Sheets

Figure 1:
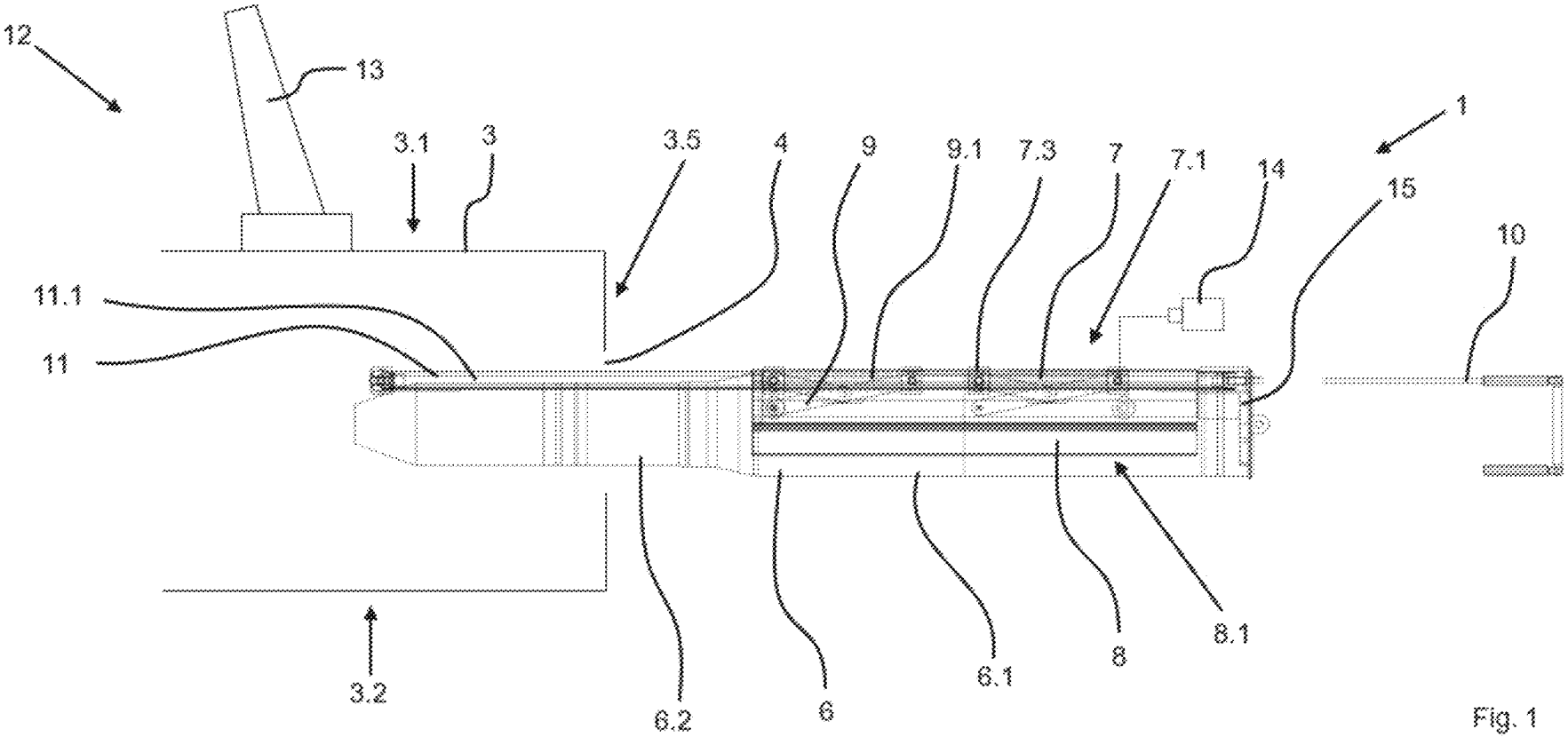

(51) Int. Cl.
*F41A 9/22* (2006.01)
*F41A 9/83* (2006.01)

(58) Field of Classification Search
USPC ..... 89/45
See application file for complete search history.

(56) References Cited

FOREIGN PATENT DOCUMENTS

| | | | | | |
|---|---|---|---|---|---|
| GB | 191124285 | A | * | 10/1912 | ..... F41A 9/20 |
| WO | WO-9825095 | A1 | * | 6/1998 | ..... F41A 9/20 |
| WO | WO-2019106106 | A1 | * | 6/2019 | ..... F41A 9/22 |

* cited by examiner

FEEDING DEVICE FOR LOADING AND UNLOADING A RADIALLY OPENING AMMUNITION CUP FOR AN AUTOMATIC GUN LOADING SYSTEM

CROSS-REFERENCE TO RELATED APPLICATIONS (Not Applicable)

STATEMENT REGARDING FEDERALLY SPONSORED RESEARCH OR DEVELOPMENT (Not Applicable)

THE NAMES OF THE PARTIES TO A JOINT RESEARCH AGREEMENT (Not Applicable)

INCORPORATION-BY-REFERENCE OF MATERIAL SUBMITTED ON A READ-ONLY OPTICAL DISC, AS A TEXT FILE OR AN XML FILE VIA THE PATENT ELECTRONIC SYSTEM (Not Applicable)

STATEMENT REGARDING PRIOR DISCLOSURES BY THE INVENTOR OR A JOINT INVENTOR (Not Applicable)

BACKGROUND OF THE INVENTION

Field of the Invention

The invention relates to a feeding device for loading and unloading a radially opening ammunition cup for an automatic loading system of a gun with the features of the generic term of Claim 1.

Description of Related Art Including Information Disclosed Under 37 CFR 1.97 and 1.98

The magazines of, for example, armoured vehicles have a bucket chain or a belt conveyor on which a plurality of containers, the so-called buckets or ammunition buckets, for receiving ammunition, mortar shells, rockets or mines are arranged. The containers are also referred to as ammunition loading containers. With the aid of the bucket chain or the belt conveyor, the ammunition is conveyed to a cannon or to a feeder of a cannon. In the following, magazines are also referred to as ammunition feed. The terms ammunition and cartridge are used synonymously. Conventional ammunition has a casing for receiving a propellant charge. The sleeve is adjoined by a projectile. In the event of a shot, the propellant charge is ignited and the projectile is fired through a weapon barrel.

In typical armoured vehicles, loading openings for automatic magazines or automatic loading systems are weak points in the armour and must therefore be mounted on the rear side of the vehicle facing away from the opponent. Attachment to the air-facing upper side is not possible, since in this way the defensive capability with respect to air targets is reduced. Attachment to the underside is likewise generally not possible for reasons of accessibility for the user.

DE 1938681 A discloses an automatic loading device which has a revolving magazine of a plurality of ammunition containers which are guided on one another along a guide parallel to one another and to the axis of the weapon in a fixed position. Arranged between the magazine and the weapon is a transfer device which consists of two tubes pushed into one another in a telescopic manner. The transfer of the ammunition from the magazine into the weapon takes place in two phases, a first phase, in which the ammunition is pushed axially out of the magazine into the inner tube of the transfer device, and a second phase, in which the ammunition is advanced by means of the inner tube and is finally pushed axially out of the latter into the weapon.

DE 2948146 A1 discloses an automatic loading device in which the ammunition is supplied to the weapon in a chain of ammunition cups. The ammunition is pushed with an axial movement directly into the cups and at a later point in time out of the cups into the weapon. The cups are in principle designed as two units in which an outer tube forms the outer casing and an inner tube holds the ammunition by means of a holding device.

The functional principle of axial loading and unloading requires that the cylindrical cups must be designed as open tubes without end-face covering. Fixed devices such as opening mechanisms in radially opening ammunition cups cannot be attached to the end faces of the ammunition cups in this form of loading and unloading. An example of ammunition cups of this type is disclosed in DE 3046642 A1.

BRIEF SUMMARY OF THE INVENTION

A particular technical problem is therefore the loading and unloading of radially opening ammunition cups from the rear of the vehicle.

The invention is based on the task of providing a feeding device for loading and unloading a radially opening ammunition cup for an automatic loading system of a gun, in which the loading/unloading of the ammunition cup is possible at the rear side of an automatic loading system for guns.

This task underlying the invention is now first solved by a feeding device according to the invention for loading and unloading a radially opening ammunition cup for an automatic loading system of a gun with the features of Claim 1.

The basic principle of the invention lies first of all essentially in the fact that the feeding device has a carriage and a holding device. The carriage can be moved from a first position into a second position and vice versa. In the first position, the carriage is arranged at least partially outside the housing. In contrast, in the second position, the carriage is arranged at least partially inside the housing and essentially parallel to an axis of the ammunition cup. The holding device is designed to be loaded and unloaded with the ammunition in the first position. The holding device is furthermore designed to transfer an ammunition arranged in the holding device to the ammunition cup in the second position. Furthermore, the holding device is designed to remove an ammunition arranged in the ammunition cup from the ammunition cup in the second position. During the movement from the first position into the second position or vice versa, the carriage can be guided through the loading opening.

The essentially parallel arrangement of the carriage in the second position with respect to an axis of the ammunition cup means that it is possible to deviate from the parallel arrangement as long as it is ensured that the ammunition can be guided out of the holding device into the ammunition cup or back perpendicularly to a longitudinal axis of the ammunition without being subjected to tilting and without being subjected to severe impact loads.

The advantage of the parallel arrangement of the carriage in the second position with respect to an axis of the ammunition cup is that the ammunition cup, the carriage and the holding device can be arranged in an installation space of particularly small axial length.

By guiding the ammunition perpendicular to a longitudinal axis of the ammunition towards the ammunition cup or out of the ammunition cup, it is possible for the ammunition cup to have a type of cover adjacent to at least one end face of the ammunition, in particular a case base. The end face of the ammunition, in particular the case bottom, can be supported by means of such a cover, so that the ammunition is then protected particularly well by the ammunition cup from shocks and vibrations.

Advantageously, the carriage can be moved by means of a first motor from the first position into the second position and vice versa.

A further automation of the feeding device is made possible by means of such a first motor. In addition, the feeding process is facilitated by the first motor; in particular, no force is to be applied by an operator of the feeding device in order to guide the carriage, the holding device and any ammunition arranged in the holding device back and forth between the first position and the second position of the carriage. The first motor could be designed, for example, as an electric motor, in particular as a servomotor, or else as a linear motor.

In a further embodiment of the feeding device, the carriage has a handle. The carriage can be moved by means of the handle by an operator of the feeding device from the first position into the second position and vice versa.

By means of the handle, the carriage can be moved back and forth between the first position and the second position in a simple manner. Such manual operation is provided as an alternative or in addition to the first motor described above. The additional presence of the first motor and the handle results in redundancy. If the first motor or the handle is defective, the carriage can be moved by means of the respective other element from the first position into the second position and vice versa.

The carriage and the holding device are preferably coupled by means of a gear. By means of the gear, a movement of the holding device perpendicular to a direction of movement of the carriage, namely from a first holding position to a second holding position, is essentially made possible. When the holding device is in the first holding position, a first distance is formed between the holding device and the carriage. When the holding device is in the second holding position, a second distance is formed between the holding device and the carriage. The first distance has a smaller value than the second distance.

By means of the gear mechanism, reliable guidance of the ammunition in the holding device between the first holding position to the second holding position and back is made possible, wherein reliable guidance means that the ammunition is not subjected to shock or impact loads. Such shock or impact loads could damage the ammunition and impair its intended function.

In a preferred embodiment of the feeding device, the gear has a crank, it being possible for the holding device to be guided by means of the crank from the first holding position into the second holding position or back.

By means of the crank, a simple actuation by an operator is made possible, the ammunition thus still being able to be moved quickly and reliably by means of the crank.

The gear preferably has a second motor. The holding device can be guided by means of the second motor from the first holding position into the second holding position or back.

By means of such a second motor, a further automation of the feeding device is made possible. The second motor can be used as an alternative or in addition to the crank.

It is conceivable for the holding device not to be of movable design, but to be connected fixedly to the carriage. The displacement of the ammunition perpendicular to the longitudinal axis of the ammunition out of the ammunition cup and into the holding element or in the opposite direction could then be effected, for example, by means of a miniature lifting platform arranged on the ammunition cup.

In a further embodiment of the feeding device, the holding device is at least partially tubular.

Thus, a multiplicity of conventional types of ammunition, namely with a cylindrical outer circumference, can be picked up and/or supported particularly well by the holding device.

The ammunition can advantageously be enclosed by means of the holding device in a radial direction of the ammunition by more than 180°, so that the ammunition can be supported by means of the holding device in the downward direction against the force of gravity. On the holding device, an opening arranged at the bottom in the vertical direction extends over the entire horizontal length of the holding device.

Because of the opening, a simultaneous support of the ammunition by means of the holding device and the ammunition cup is made possible. This leads to a particularly simple and low-impact pick-up or delivery of the ammunition out of the ammunition cup or into the ammunition cup.

In an advantageous embodiment of the feeding device, the ammunition can be supported in a first, rear region of larger diameter by means of the holding device in the downward direction, counter to the force of gravity. The ammunition can also be guided through the opening of the holding device in a second, front region perpendicular to a longitudinal axis of the ammunition.

A holding device designed in this way is particularly simple to produce and furthermore very robust during its operation, since the holding device has, in particular, no movable components and is designed, for example, in one piece. By means of the holding device designed in this way, a simple method for dispensing or receiving the ammunition into the ammunition cup or out of the ammunition cup is made possible. When the ammunition is unloaded from the ammunition cup, the holding device is slipped over the second, front region of the ammunition. Subsequently, the holding device is moved by means of the carriage in the axial direction of the ammunition until the holding device at least partially encloses the first, rear region of the ammunition. The holding device is then moved together with the ammunition towards the carriage into the first holding position.

A loading process takes place in the opposite direction. The holding device is moved with the ammunition towards the ammunition cup until the ammunition rests on the ammunition cup. The holding device is then moved by means of the carriage in the axial direction of the ammunition until the holding device is arranged parallel to the second, front region of the ammunition. Finally, the holding device is moved towards the carriage, the ammunition being guided through the opening so that the ammunition remains in the ammunition cup.

The holding device preferably has at least one gripping shell and a main body. The at least one gripping shell is held pivotably on the main body, the at least one gripping shell being pivotable back and forth between a gripping shell release position and a gripping shell holding position. The ammunition can be fed to the holding device in the radial direction and/or the ammunition can be removed from the holding device in the radial direction when the at least one gripping shell is located in the gripping shell release position.

The loading and unloading process can be simplified by means of a holding device designed in this way. As a result of the movement of the gripping shell, the support of the ammunition by means of the holding device can be terminated or started. An axial movement of the holding device for producing or releasing the support is then no longer necessary. In order to load the ammunition cup with the ammunition, the holding device with the gripping shell in the gripping shell holding position and including the ammunition is guided to the ammunition cup, in particular until the ammunition rests on the ammunition cup. The gripping shell is then pivoted into the gripping shell release position and the holding device is guided away from the ammunition cup without the ammunition.

For unloading the ammunition cup, the empty holding device with the gripping shell is guided to the ammunition cup in the gripping shell release position, in particular until the holding device with the main body touches the ammunition. The gripping shell is then pivoted into the gripping shell holding position and the holding device is guided away from the ammunition cup together with the ammunition.

In a further embodiment of the feeding device, the feeding device has at least one guide. The guide is arranged and/or fastened on the housing. The carriage can be guided by means of the guide during the movement from the first position into the second position or back by means of the guide.

Preferably, a length of the guide is less than or equal to a length of the ammunition. Thus, the feeding device as a whole can be designed to be very compact. In particular, the feeding device has dimensions in the longitudinal direction of the ammunition cups or ammunition which exceed the length of the ammunition by only a few percent.

In an advantageous embodiment of the feeding device, the guide has at least one telescopic rod and at least one inner spindle. The telescopic rod can be retracted and extended by means of the spindle.

In an alternative embodiment of the feeding device, the guide has at least one guide rail. The carriage can be guided and/or supported on the guide rail, in particular with the aid of rollers mounted on the carriage.

Mechanisms designed in this way are simple to produce and robust during their operation. Furthermore, very precise guidance of the carriage and of the holding device is made possible.

In an advantageous embodiment of the feeding device, the guide rail has a guide rail opening. The holding device has a support, wherein the holding device can be guided and/or supported against the force of gravity on the guide rail by means of the support. When the carriage is in the second position or close to the second position, the support can be guided through the guide rail opening, in which case the holding device can then be guided from the first holding position to the second holding position, in particular alone, on account of the force of gravity.

Thus, the loading process and/or the unloading process of the ammunition cup with an ammunition is facilitated. The force for moving the holding device from the first holding position to the second holding position need not be provided by an operator or a motor.

Advantageously, the gear has at least one spring. The guiding of the holding device from the first holding position to the second holding position then takes place against a spring force exerted by the spring.

By means of the spring, the speed of the movement of the holding device from the first holding position to the second holding position is influenced, in particular limited. Such a spring can be designed in different ways. Thus, for example, it is conceivable that the spring is designed to be so strong that although a movement of the holding device from the first holding position to the second holding position with the ammunition is made possible on account of gravity, the holding device is held without ammunition but in the first holding position by means of the spring. Then, during the loading process, after the ammunition has been deposited in the ammunition cup, the holding device is guided by means of the spring from the second holding position back to the first holding position. For the unloading process, with such a design of the spring, an additional force must then be applied to the holding device, for example by means of a crank, in order to move the holding device from the first holding position to the second holding position without ammunition.

Alternatively, it is conceivable that the spring is designed to be less strong, so that the holding device remains in the second holding position without ammunition, despite the spring force. Then, during the loading process, after the ammunition has been deposited in the ammunition cup, the holding device must be guided back from the second holding position to the first holding position by means of an additional force, for example by means of a crank. During the unloading process, a movement of the holding device from the first holding position to the second holding position then takes place without ammunition on account of the force of gravity.

There are a number of possibilities for configuring and further developing the feeding device according to the invention for loading and unloading a radially opening ammunition cup for an automatic loading system of a gun. Reference may first be made to the claims subordinate to Claim 1. In the following, a preferred embodiment of the feeding device according to the invention for loading and unloading a radially opening ammunition cup for an automatic loading system of a gun will now be explained in more detail with reference to the drawing and the associated description.

BRIEF DESCRIPTION OF THE SEVERAL VIEWS OF THE DRAWING(S)

Figure 2:
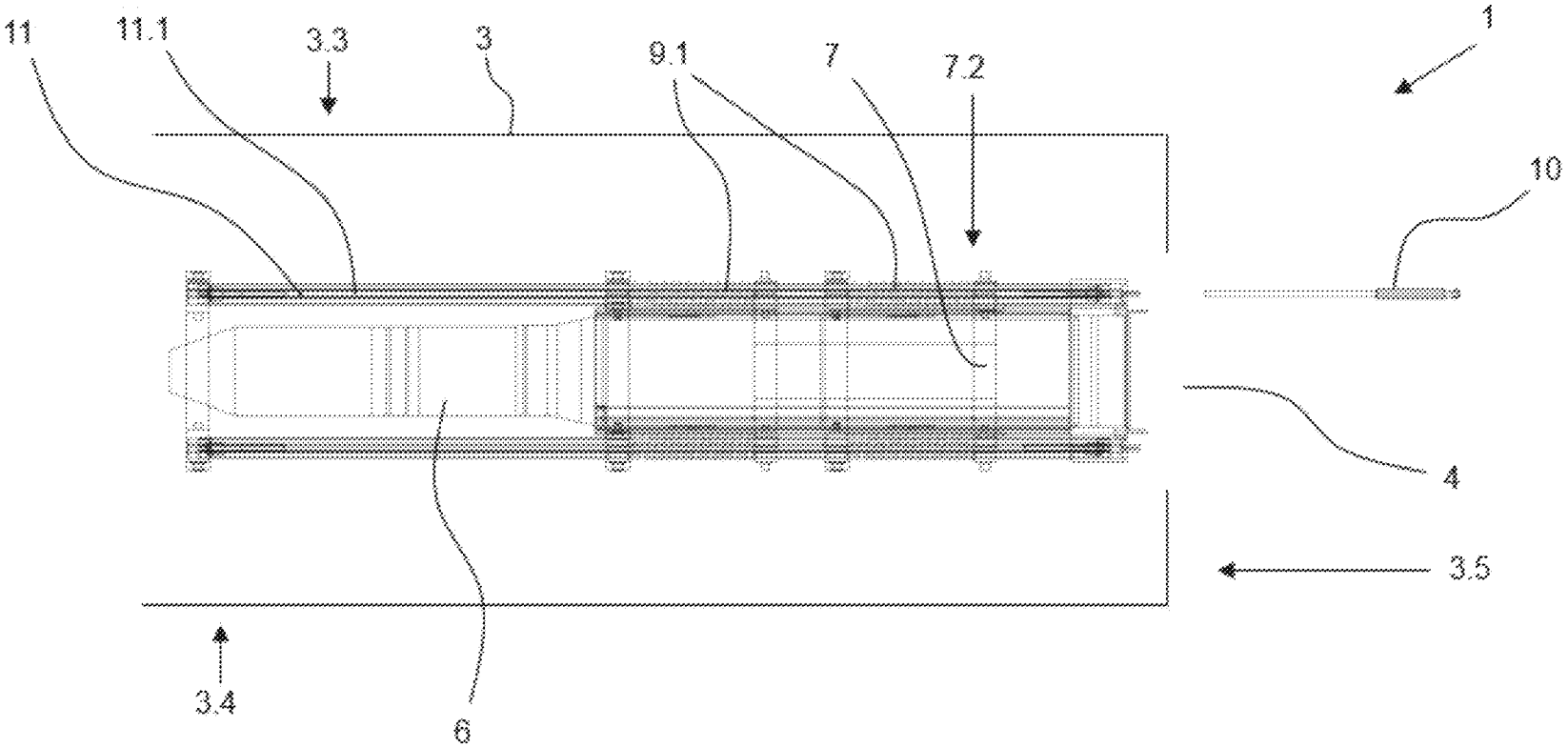
Figure 2A:
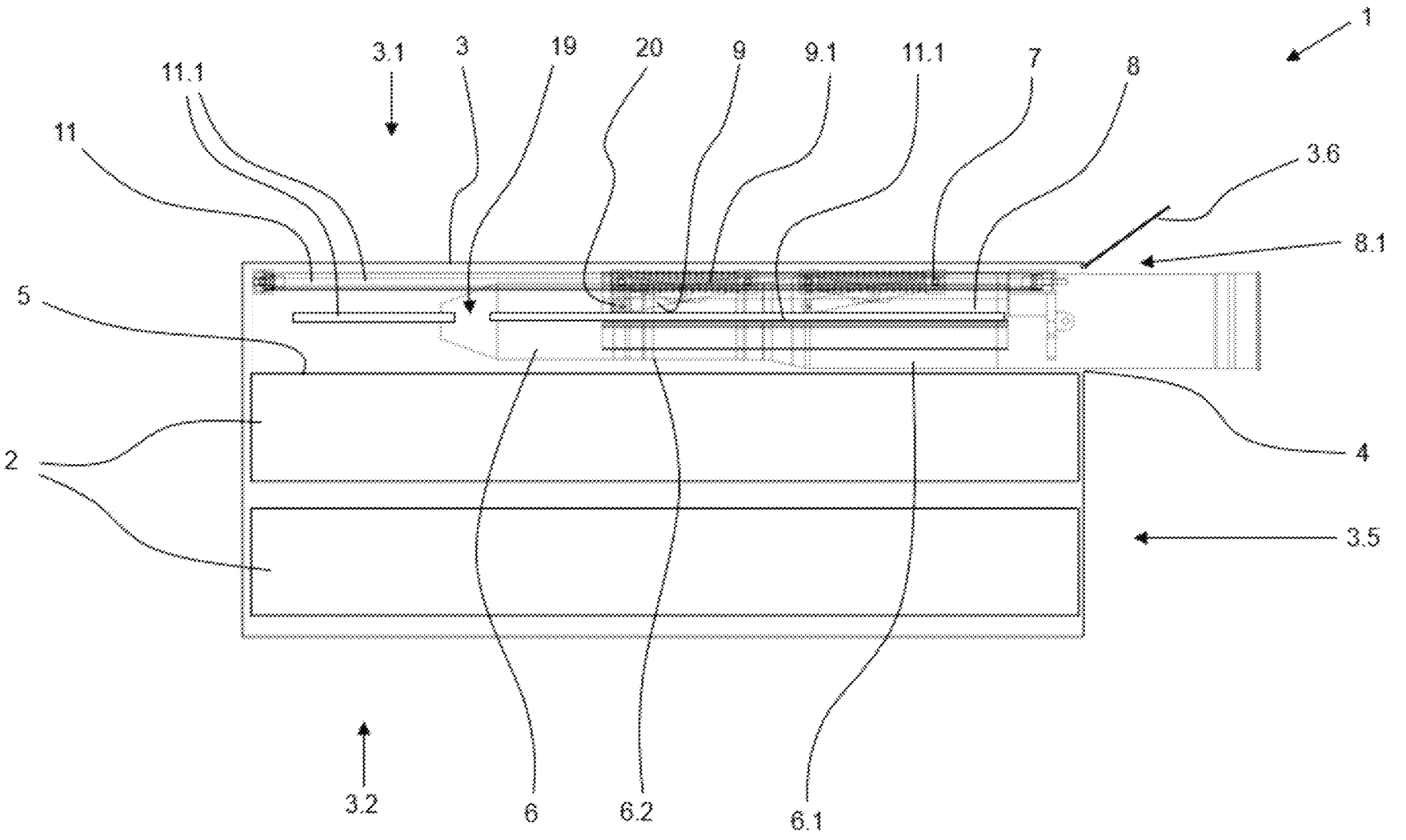
Figure 2B:
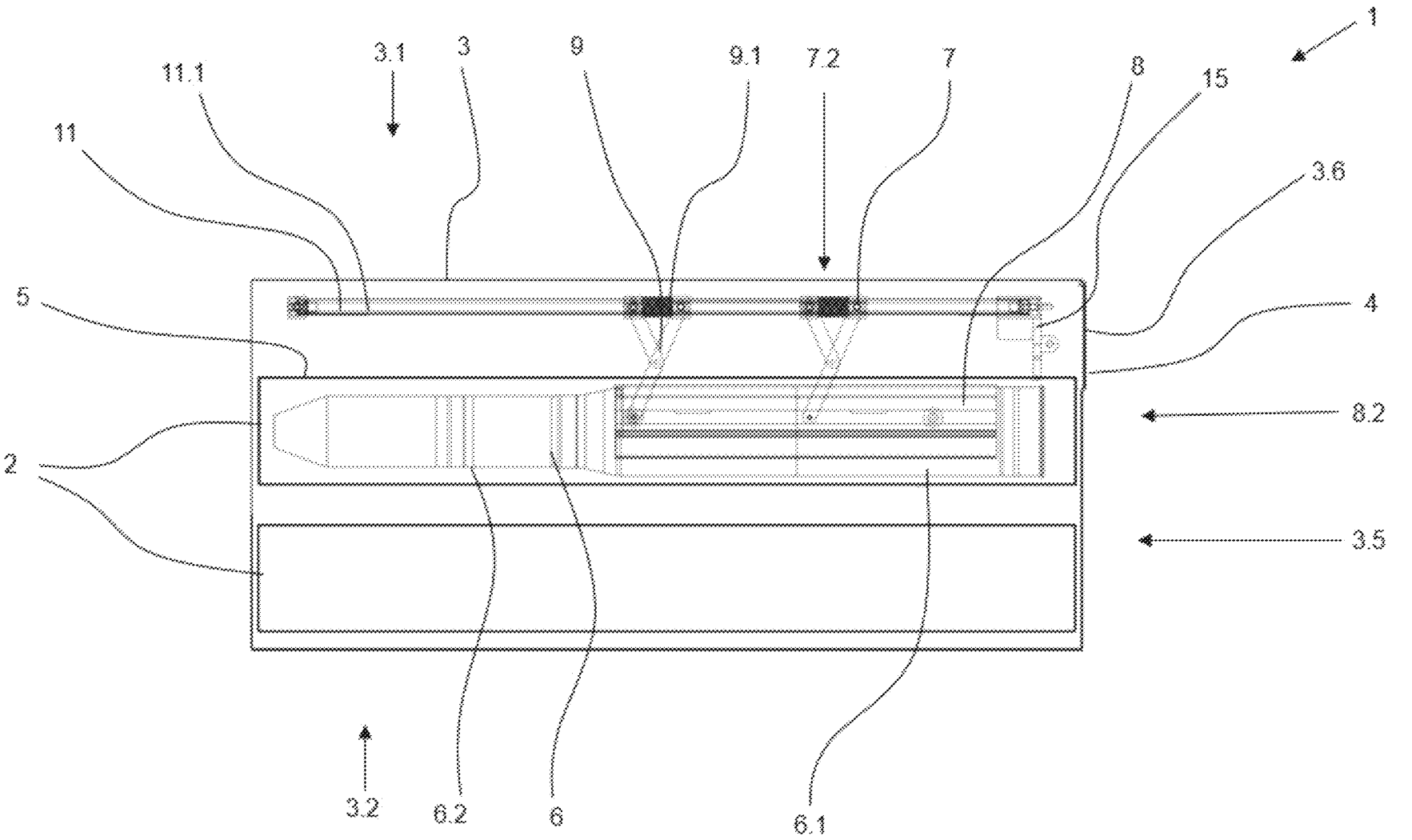
Figure 3:
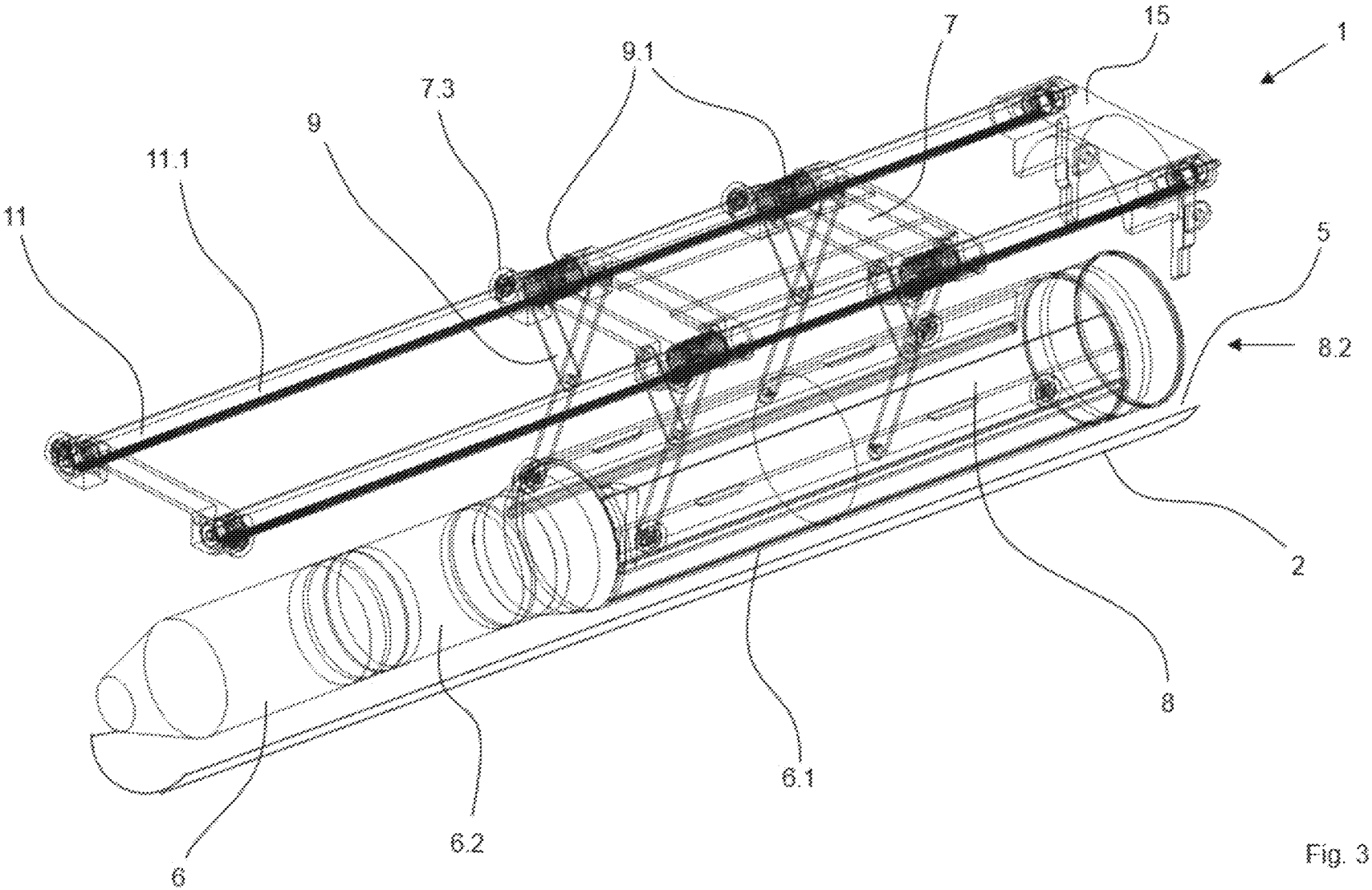
Figure 4:
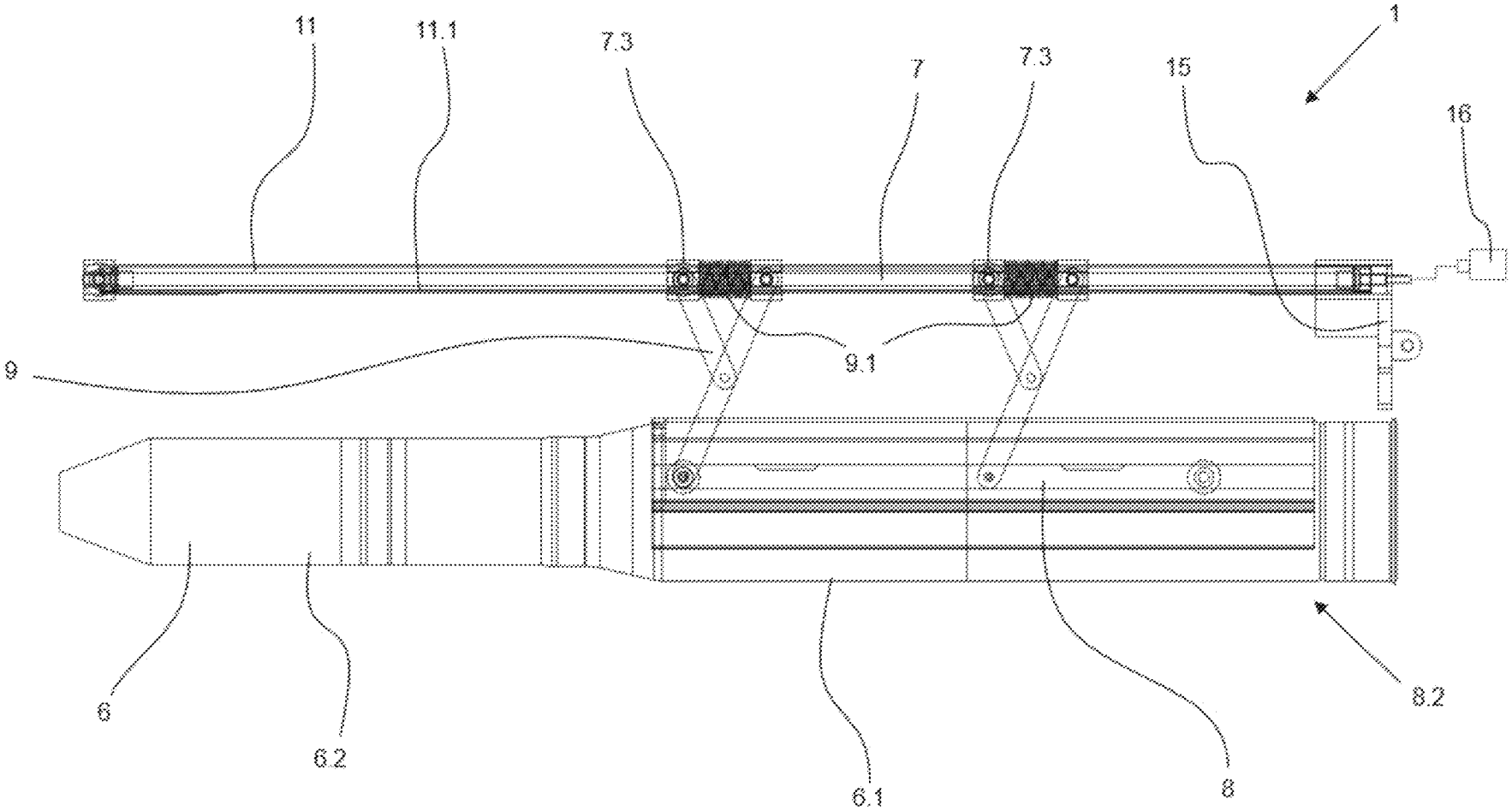
Figure 5:
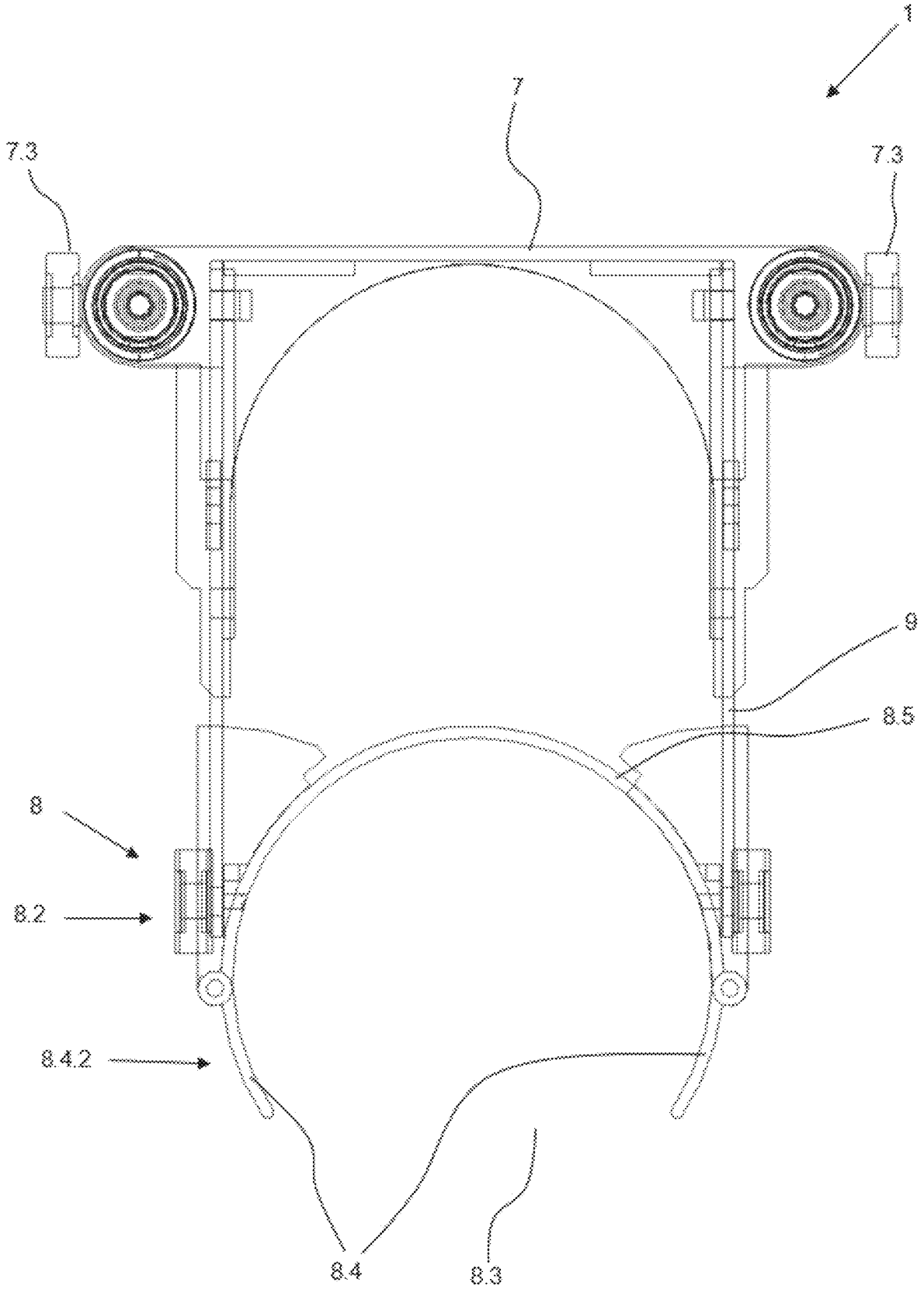
Figure 6:
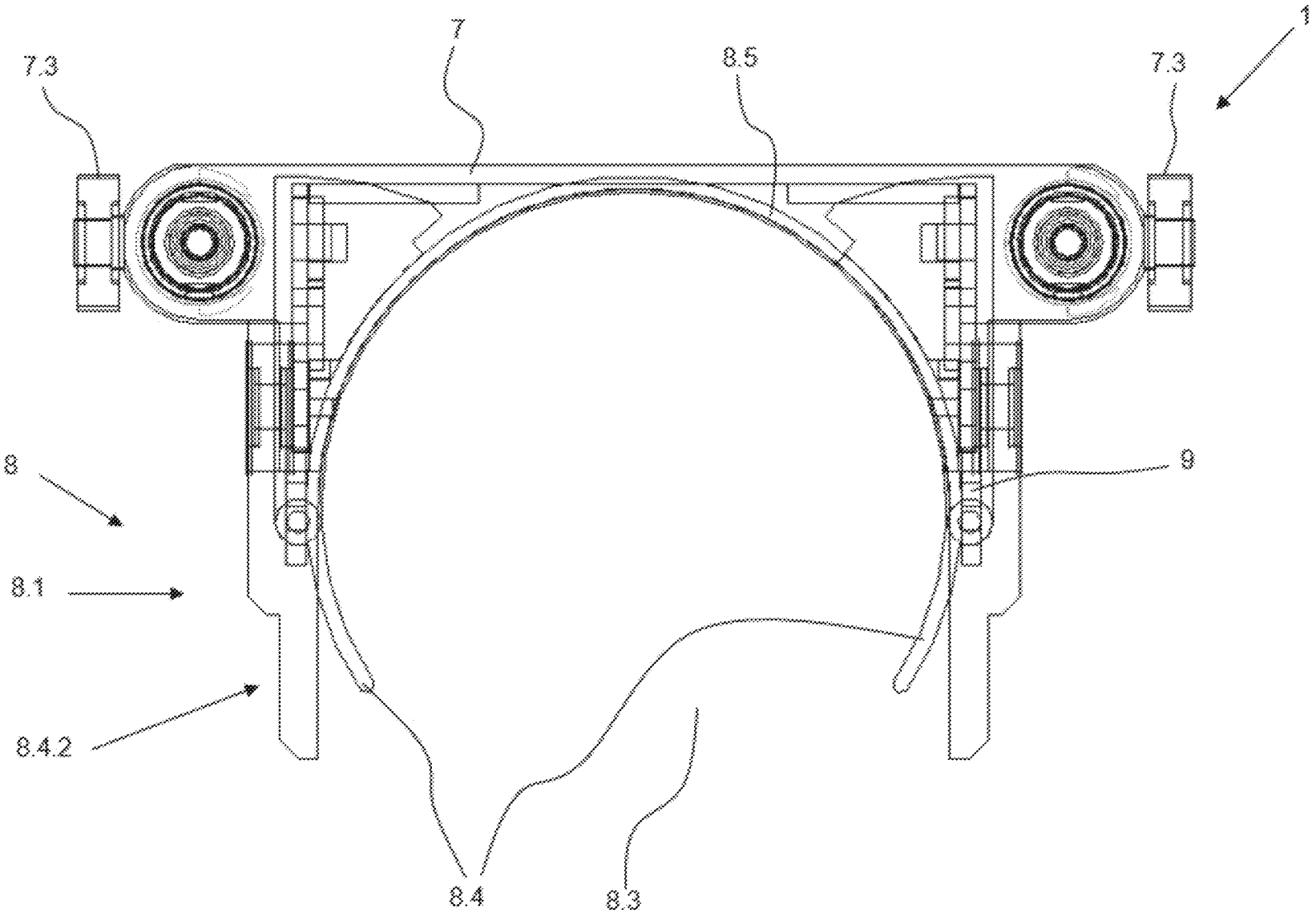
Figure 7:
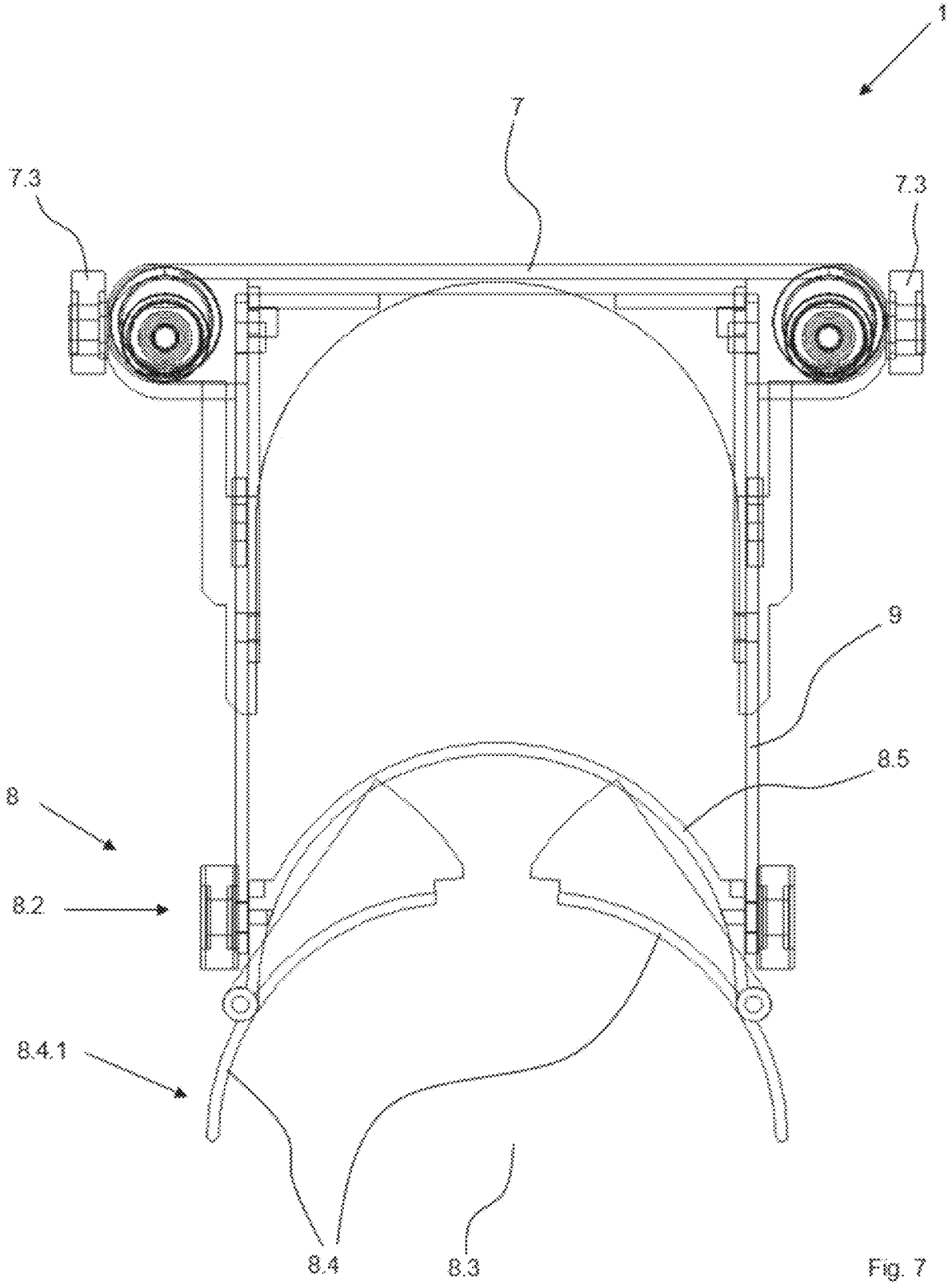
Figure 8:
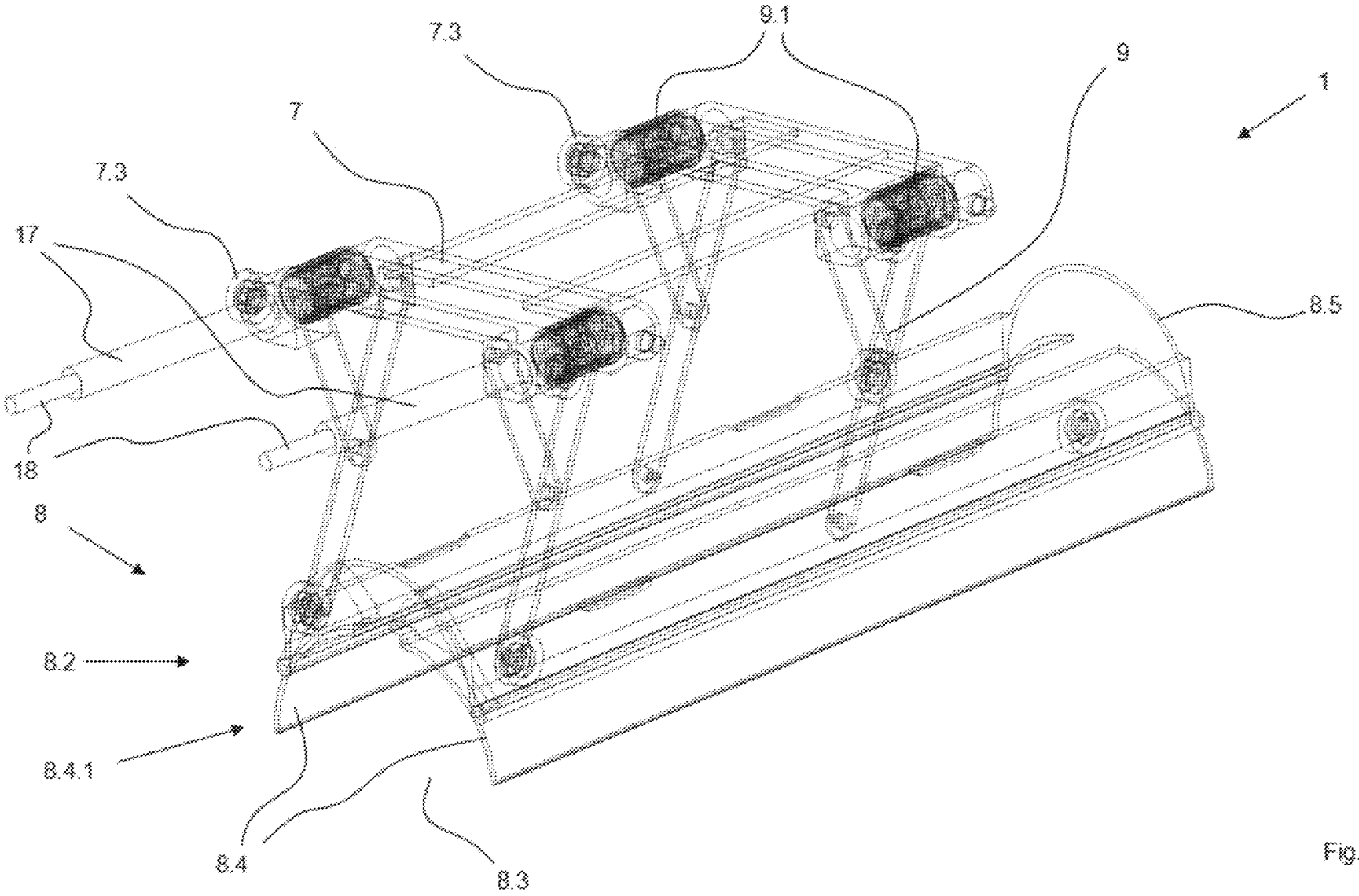

FIG. 1 schematically shows an exemplary embodiment of a feeding device for loading and unloading a radially opening ammunition cup for an automatic loading system of a gun with a carriage in a first position and a holding device in a first holding position in a side view, FIG. 2 schematically shows the exemplary embodiment of the feeding device with the carriage in a second position in a plan view, FIG. 2*a* schematically shows the embodiment of the feeding device with the carriage between the first position and the second position and the holding device in the first holding position in a side view, FIG. 2*b* schematically shows the embodiment of the feeding device with the carriage in the second position and the holding device in the second holding position in a side view, FIG. 3 schematically shows the exemplary embodiment of the feeding device with the holding device in the second holding position in a three-dimensional view, FIG. 4 schematically shows the exemplary embodiment of the feeding device with the holding device in the second holding position in a side view, FIG. 5 schematically shows the exemplary embodiment of the feeding device with the holding device in the second holding position and with a gripping shell in a gripping shell holding position in an end view, FIG. 6 schematically shows the exemplary embodiment of the feeding device with the holding device in the first holding position and with the gripping dish in the gripping dish holding position in an end view, FIG. 7 schematically shows the exemplary embodiment of the feeding device with the holding device in the second holding position and with the gripping dish in a gripping dish release position in an end view, and FIG. 8 schematically shows the embodiment of the feeding device with the holding device in the second holding position and with the gripping shell in the gripping shell release position in a three-dimensional view.

DETAILED DESCRIPTION OF THE INVENTION

FIG. 1 schematically shows a side view of a first exemplary embodiment of a feeding device 1 for loading and unloading a radially opening ammunition cup 2 for an automatic loading system of a gun. All the other figures show the same exemplary embodiment and the same reference numerals are used for the same components in all the figures.

The feeding device 1 for loading and unloading the radially opening ammunition cup 2 for an automatic loading system of a gun comprises a housing 3, a loading opening 4 and the radially opening ammunition cup 2. The housing 3 comprises an upper side 3.1, a lower side 3.2, two lateral sides, namely a first lateral side 3.3 and a second lateral side 3.4, and a rear side 3.5. The loading opening 4 is arranged and/or formed in the rear side 3.5 of the housing 3. The ammunition cup 2 has a cup opening 5. An ammunition 6 can be inserted into the ammunition cup 2 in the radial direction through the cup opening 5, or an ammunition 6 can be removed from the ammunition cup 2 in the radial direction through the cup opening 5.

The cup opening 5 could be formed invariably in the ammunition cup 2. Alternatively, it is conceivable for the ammunition cup 2 to have a carrying shell and at least one flap, wherein the flap is held pivotably on the carrying shell, wherein the flap can be pivoted back and forth between a flap release position and a flap holding position. In this case, the cup opening 5 is formed in the ammunition cup 2 when the flap is in the flap release position.

The feeding device 1 has a carriage 7 and a holding device 8. The carriage 7 can be moved from a first position 7.1 into a second position 7.2 and vice versa. In the first position 7.1 the carriage 7 is arranged at least partially outside the housing 3. In contrast, in the second position 7.2, the carriage 7 is arranged at least partially inside the housing 3 and essentially parallel to an axis of the ammunition cup 2. The holding device 8 is designed to be loaded and unloaded with the ammunition 6 in the first position 7.1. The holding device 8 is also designed to transfer an ammunition 6 arranged in the holding device 8 to the ammunition cup 2 in the second position 7.2. The holding device 8 is further adapted to take out of the ammunition cup 2, in the second position 7.2, an ammunition 6 arranged in the ammunition cup 2 During the movement from the first position 7.1 into the second position 7.2 or vice versa, the carriage 7 can be guided through the loading opening 4.

The loading opening 4 can be closed by means of a loading flap 3.6. The loading flap 3.6 is arranged pivotably on the housing 3 adjacent to the loading opening 4. In order to guide the carriage 7 through the loading opening 4, the loading flap 3.6 must first be pivoted, in particular by means of a handle by hand.

The carriage 7 can be moved, for example, by means of a first motor from the first position 7.1 into the second position 7.2, and vice versa.

Alternatively or additionally, the carriage 7 has a handle. The carriage 7 can be moved by means of the handle by an operator of the feeding device 1 from the first position 7.1 into the second position 7.2, and vice versa.

In particular, the handle is movably arranged on the carriage 7, wherein the handle can be guided into an associated latching position in the first position 7.1 and/or in the second position 7.2, wherein a movement of the carriage 7 is mechanically prevented in the latching positions.

The carriage 7 and the holding device 8 are coupled by means of a gear 9. By means of the gear 9, a movement of the holding device 8 perpendicular to a direction of movement of the carriage 7, namely from a first holding position 8.1 to a second holding position 8.2, is essentially made possible. When the holding device 8 is in the first holding position 8.1, a first distance is formed between the holding device 8 and the carriage 7. When the holding device 8 is in the second holding position 8.2, a second distance is formed between the holding device 8 and the carriage 7. The first distance has a smaller value than the second distance. FIG. 1, FIG. 2 and FIG. 2*a* show the holding device 8 in the first holding position 8.1. FIG. 2*b*, FIG. 3 and FIG. 4 show the holding device 8 in the second holding position 8.2.

In particular, the handle has a half shell, the half shell being open at the top when the carriage 7 is arranged in the first position 7.1 and the handle in the associated latching position, so that the ammunition 6 can be supported on the half shell by an operator, in particular by two operators, when it is fed to the holding device 8. In this way, the manual supply of the ammunition 6 to the holding device 8 is facilitated.

The gear 9 has a crank 10, wherein the holding device 8 can be guided by means of the crank 10 from the first holding position 8.1 into the second holding position 8.2 or back. The crank 10 has a plurality of joints, it being possible for the crank 10 to be arranged in a space-saving manner by means of the joints when it is not required at the moment. The gear 9 has a second motor. The holding device 8 can be guided by means of the second motor from the first holding position 8.1 into the second holding position 8.2 or back. The second motor is provided as an alternative or in addition to the crank 10.

The holding device 8 is at least partially tubular. The ammunition 6 can be enclosed by more than 180° in a radial direction of the ammunition 6 by means of the holding device 8, so that the ammunition 6 can be supported downwardly, against gravity, by means of the holding device 8. On the holding device 8, an opening 8.3 arranged at the bottom in the vertical direction extends over the entire horizontal length of the holding device 8.

In other words, the holding device 8 has a tube, the tube being slotted along the longitudinal axis of the tube to form the opening 8.3.

It is conceivable for the ammunition 6 to be able to be supported in a first, rear region 6.1 of larger diameter by means of the holding device 8 in the downward direction, counter to the force of gravity. The ammunition 6 can then be guided through the opening 8.3 of the holding device 8 in a second, front region 6.2 perpendicular to a longitudinal axis of the ammunition 6.

Alternatively or additionally, the holding device 8 has at least one gripping shell 8.4, in particular a first gripping shell and a second gripping shell, and a main body 8.5. On the main body 8.5, the at least one gripping shell 8.4 is pivotably held, wherein the at least one gripping shell 8.4 is pivotable back and forth between a gripping shell release position 8.4.1 and a gripping shell holding position 8.4.2. The ammunition 6 can be fed to the holding device 8 in the radial direction or the ammunition 6 can be removed from the holding device 8 in the radial direction when the at least one gripping shell 8.4 is located in the gripping shell release position 8.4.1.

The function of the holding device 8 with the at least one gripping shell 8.4 can be seen in particular from FIG. 5 to 8. FIG. 5 and FIG. 6 show two gripping shells 8.4 in the gripping shell holding position 8.4.2. FIG. 7 and FIG. 8 show two gripping shells 8.4 in the gripping shell release position 8.4.1.

The back and forth pivoting of the gripping shells 8.4 between the gripping shell release position 8.4.1 and the gripping shell holding position 8.4.2 could be implemented by means of a ratchet mechanism. A latch mechanism of this type could, for example, be mechanically activated by means of the ammunition cup when the holding device 8 is moved to the second position 8.2, so that the gripping shell 8.4 is then pivoted from the gripping shell holding 8.4.2 to the gripping shell release position 8.4.1.

The feeding device 1 has at least one guide 11. The guide 11 is arranged and/or fastened on the housing 3. The carriage 7 can be guided by means of the guide 11 during the movement from the first position 7.1 into the second position 7.2. or back by means of the guide 11. A length of the guide 11 is less than or equal to a length of the ammunition 6. The guide 11 could have at least one telescopic rod and at least one inner spindle. The telescopic rod can then be retracted and extended by means of the spindle. The guide 11 has at least one guide rail 11.1. The carriage 7 can be guided and/or supported on the guide rail 11, in particular with the aid of rollers 7.3 mounted on the carriage 7.

The guide rail 11.1 optionally has a guide rail opening. The holding device 8 has a support, wherein the holding device 8 can be guided and/or supported against the force of gravity on the guide rail 11.1 by means of the support. When the carriage 7 is in the second position 7.2. or close to the second position 7.2, the support can be guided through the guide rail opening, in which case the holding device 8 can then be guided from the first holding position 8.1 to the second holding position 8.2, in particular alone, on account of the force of gravity.

The gear 9 has at least one spring 9.1. The movement of the holding device 8 from the first holding position 8.1 to the second holding position 8.2 then takes place against a spring force exerted by the spring 9.1.

The feeding device 1 is designed in particular for an ammunition 6 with an ammunition caliber of 120 mm and greater.

It is conceivable that a haptic and/or visual and/or acoustic signal is generated by means of the feeding device 1 when the carriage 7 has reached the first position 7.1 or the second position 7.2. after a movement of the carriage 7, so that the operator is informed when the first position 7.1 or the second position 7.2. has been correctly assumed by the carriage 7.

The method for loading and unloading radially opening ammunition cups 2 in an automatic loading system will now be described below.

The method for loading radially opening ammunition cups 2 in the automatic loading system comprises the steps of:

a) opening the loading flap 3.6 of the loading opening 4 of the automatic loading system,
(b) extending the carriage 7 from the second position 7.2 to the first position 7.1;
(c) inserting the ammunition 6 into the holding device 8;
d) inserting the carriage 7 with the ammunition 6 into the second position 7.2 through the loading opening 4 into the housing 4, and
e) Transferring the ammunition 6 from the holding device 8 into the radially opening ammunition cup 2 perpendicular to the longitudinal axis of the ammunition cup 2.

The method for unloading radially opening ammunition cups 2 in the automatic loading system comprises the steps of:

a) transferring the ammunition 6 from the radially opening ammunition cup 2 substantially perpendicular to the longitudinal axis of the ammunition cup 2 into the holding device 8,
b) opening the loading flap 3.6 of the loading opening 4 of the automatic loading system;
c) pulling the carriage 7 out of the second position 7.2 into the first position 7.1, and
d) removing the ammunition 6 from the holding device 8.

LIST OF REFERENCE NUMERALS

1 Feeder
2 Ammunition cups
3 Housing
3.1 Top
3.2 Bottom
3.3 First lateral side
3.4 Second lateral side
3.5 Rear
3.6 Loading flap
4 Loading opening
5 Cup opening
6 Ammunition
6.1 First, rear region
6.2 Second, front region
7 Carriages
7.1 First position
7.2 Second position
7.3 Rollers
8 Holding device
8.1 First holding position
8.2 Second holding position
8.3 Opening
8.4 Gripping tray
8.4.1 Gripping tray release position

8.4.2 Gripping tray holding position
8.5 Main Body
9 Transmission
9.1 Spring
10 Crank
11 Guide
11.1 Guide rail

The invention claimed is:

1. A feeding device (1) for loading and unloading a radially opening ammunition cup (2) for an automatic loading system (12) of a gun (13), comprising: a housing (3), a loading opening (4) and the radially opening ammunition cup (2), wherein the housing (3) comprises an upper side (3.1), a lower side (3.2), two lateral sides (3.3, 3.4) and a rear side (3.5), wherein the loading opening (4) is arranged and/or formed in the rear side of the housing (3), and wherein the ammunition cup (2) has a cup opening (5) configured for an ammunition (6) to be guided radially through the cup opening (5) to insert the ammunition (6) into the ammunition cup (2) or remove the ammunition (6) from the ammunition cup (2); the feeding device (1) further comprising a carriage (7) and a holding device (8), wherein the carriage (7) can be moved between a first position (7.1) and a second position (7.2), wherein the carriage (7) is arranged at least partially outside the housing (3) when the carriage is in the first position (7.1) and wherein the carriage (7) is at least partially inside the housing (3) and essentially parallel to an axis of the ammunition cup (2) when the carriage is in the second position (7.2), wherein the holding device (8) is designed to be loaded and unloaded with the ammunition (6) when the carriage (7) is in the first position (7.1), wherein the holding device (8) is designed to transfer the ammunition (6) to the ammunition cup (2) when the carriage (7) is in the second position (7.2), wherein the holding device (8) is designed to take the ammunition (6) out of the ammunition cup (2) when the carriage (7) is in the second position (7.2), and wherein the carriage (7) can be guided through the loading opening (4) during the movement between the first position (7.1) and the second position (7.2).

2. The feeding device (1) according to claim 1, wherein the carriage (7) is movable by a first motor (14) between the first position (7.1) and the second position (7.2).

3. The feeding device (1) according to claim 1, wherein the carriage (7) has a handle (15), the carriage being movable by the handle (15) by an operator between the first position (7.1) and the second position (7.2).

4. The feeding device (1) according to claim 1, wherein the carriage (7) and the holding device (8) are coupled by a gear mechanism (9), the gear mechanism (9) permitting movement of the holding device (8) substantially perpendicular to a direction of the movement of the carriage (7) between a first holding position (8.1) and a second holding position (8.2), a first distance being formed between the holding device (8) and the carriage (7) when the holding device (8) is in the first holding position (8.1), a second distance being formed between the holding device (8) and the carriage (7) when the holding device (8) is in the second holding position (8.2), the first distance having a smaller value than the second distance.

5. The feeding device (1) according to claim 4, wherein the gear mechanism (9) has a crank (10), wherein the holding device (8) is guidable by the crank (10) between the first holding position (8.1) and the second holding position (8.2).

6. The feeding device (1) according to claim 5, wherein the gear mechanism (9) has a second motor (16), wherein the holding device (8) is guidable by the second motor (16) between the first holding position (8.1) and the second holding position (8.2).

7. The feeding device (1) according to claim 4, wherein the gear mechanism (9) has a second motor (16), wherein the holding device (8) is guidable by the second motor (16) between the first holding position (8.1) and the second holding position (8.2).

8. The feeding device (1) according to claim 4, wherein the gear mechanism (9) has at least one spring (9.1), the movement of the holding device (8) between the first holding position (8.1) and the second holding position (8.2) taking place counter to a spring force exerted by the spring (9.1).

9. The feeding device (1) according to claim 1, characterized in that the holding device (8) is at least partially tubular design.

10. The feeding device (1) according to claim 1, wherein the ammunition (6) can be enclosed by the holding device (8) by more than 1800 in a radial direction of the ammunition (6), so that the ammunition (6) can be supported, counter to the force of gravity, by of the holding device (8), wherein the holding device (8) has an opening (8.3) at a bottom thereof which extends over the entire horizontal length of the holding device (8).

11. The feeding device (1) according to claim 10, wherein the ammunition (6) can be supported in a first, rear region (6.1) of the ammunition (6) by the holding device (8) against the force of gravity, wherein a second, front region (6.2) of the ammunition (6) having a smaller diameter than the first, rear region (6.1) can be guided through the opening (8.3) of the holding device (8).

12. The feeding device (1) according to claim 1, characterized in that the holding device (8) has at least one gripping shell (8.4) and a main body (8.5), the at least one gripping shell (8.4) being held pivotably on the main body (8.5), the at least one gripping shell (8.4) being pivotable between a gripping shell release position (8.4.1) and a gripping shell holding position (8.4.2), wherein the holding device (8) is adapted to radially receive the ammunition (6) therein or radially remove the ammunition (6) therefrom, when the at least one gripping shell (8.4) is in the gripping shell release position (8.4.1).

13. The feeding device (1) according to claim 1, further comprising at least one guide (11), the guide (11) being arranged and/or fastened to the housing (3), wherein the carriage (7) is guidable by the guide (11) during the movement of the carriage (7) between the first position (7.1) and the second position (7.2).

14. The feeding device (1) according to claim 13, wherein a length of the guide (11) is less than or equal to a length of the ammunition (6).

15. The feeding device (1) according to claim 14, characterized in that the guide (11) has at least one telescopic rod (17) and at least one inner spindle (18), adapted to telescopically adjust the at least one telescopic rod (17).

16. The feeding device (1) according to claim 14, characterized in that the guide (11) has at least one guide rail (11.1), wherein the carriage (7) is guidable and/or supportable on the guide rail (11.1).

17. The feeding device (1) according to claim 13, characterized in that the guide (11) has at least one telescopic rod (17) and at least one inner spindle (18) adapted to telescopically adjust the at least one telescopic rod (17).

18. The feeding device (1) according to claim 13, characterized in that the guide (11) has at least one guide rail (11.1), wherein the carriage (7) is guidable and/or supportable on the guide rail (11.1).

19. The feeding device (1) according to claim 18, wherein the guide rail (11.1) has a guide rail opening (19), wherein the holding device (8) has a support (20), wherein the holding device (8) can be guided and/or supported by the support (20) against the force of gravity on the guide rail (11.1), wherein the support (20) can be guided through the guide rail opening (19) when the carriage (7) is in the second position (7.2), wherein the holding device (8) is then movable between a first holding position (8.1) of the holding device and a second holding position (8.2) of the holding device.

* * * * *